US008254614B2

(12) United States Patent
Pazandeh

(10) Patent No.: US 8,254,614 B2
(45) Date of Patent: Aug. 28, 2012

(54) HORN SPEAKER WITH HYPERBOLIC PARABOLOID LENS

(76) Inventor: Ira Pazandeh, Yorba Linda, CA (US)

( * ) Notice: Subject to any disclaimer, the term of this patent is extended or adjusted under 35 U.S.C. 154(b) by 57 days.

(21) Appl. No.: 12/592,526

(22) Filed: Nov. 25, 2009

(65) Prior Publication Data

US 2011/0123057 A1 May 26, 2011

(51) Int. Cl.
*H04R 25/00* (2006.01)

(52) U.S. Cl. ..... 381/340

(58) Field of Classification Search ..... 381/337, 381/338, 339, 340, 341, 342, 423; 181/175–178, 181/182, 187, 188, 189, 192
See application file for complete search history.

(56) References Cited

U.S. PATENT DOCUMENTS

| | | | | |
|---|---|---|---|---|
| 3,735,336 | A * | 5/1973 | Long | 367/150 |
| 5,526,456 | A * | 6/1996 | Heinz | 381/340 |
| 6,134,337 | A * | 10/2000 | Isaka | 381/423 |
| 6,581,719 | B2 * | 6/2003 | Adamson | 181/182 |
| 6,621,909 | B1 * | 9/2003 | Webb et al. | 381/342 |
| 7,068,805 | B2 * | 6/2006 | Geddes | 381/340 |
| 7,936,892 | B2 * | 5/2011 | Werner | 381/338 |

* cited by examiner

*Primary Examiner* — Davetta W Goins
*Assistant Examiner* — Phylesha Dabney

(57) ABSTRACT

The present invention is a new horn loudspeaker comprising multiple sound radiators mounted to the sidewalls of the horn. At least two sound radiators mounted to the sidewalls of the horn with a "Hyperbolic Paraboloid" (saddle point) shaped lens placed medially between the sound radiators creating an improved horn characteristics for more uniform directivity, improved power response, reduced beaming as a function of frequency and twice the power the power handling.

11 Claims, 3 Drawing Sheets

HORN SPEAKER WITH HYPERBOLIC PARABOLOID LENS

1. RELATED APPLICATION

This is a continuation of provisional patent application No. 61/188,496 filed Aug. 10, 2008 has been expired.

2. FIELD OF THE INVENTION

The present invention relates generally to horn loudspeaker systems and more particularly to horn speakers using at least two sound radiators with an acoustic lens to optimize directivity characteristics, power response, power handling and reduce high frequency beaming.

3. BACKGROUND OF THE INVENTION

In typical and musical playback environment there is generally what is known as "sweet spot" where sound quality is optimized. Audience in different sitting locations often experiences a lower sound quality from the sweet spot. This experience may vary from a very good sound to a less desirable sound quality produced by the loudspeakers. This is due to variation in directivity, non-uniformity and degraded power response of the radiated sound produced by these loudspeakers. The objective of the present invention is to improve the characteristics and radiation patterns of horn speakers. A great deal has gone into research in trying to find ways to further the science. This new approach solves some of the shortcomings of the prior science in this field. Detailed Description of the Invention describes the present state of the art in more details.

3. DESCRIPTION OF THE PRIOR ART

The following prior art defines the state of this field. Each disclosure further defines the present state of the field by reference:

Ampex Corporation, U.S. Pat. No. 3,735,336, describes an acoustic lens for dispersing sound waves transmitted therethrough comprising a biconcave, plano-concave or negative meniscus shaped, open called plastic foam. Lens is preferably biconcave and formed from an explosively reticulated polyurethane foam, and is particularly useful in dispersing high frequency sound waves from loudspeaker system to provide balanced response.

Geddes, U.S. Pat. No. 7,068,805, describes an acoustic waveguide contours that approximate either or both of the Elliptic Cylinder and the Prolate Spheroidal coordinate system that allows for a more accurate prediction and control over the sound radiation polar pattern are disclosed.

Adamson, U.S. Pat. No. 6,581,719, describes a loudspeaker system containing wave-shaping sound chambers with approximately rectangular inlets and outlets of substantially the same size that are used to flatten or control the curvature of the acoustic wavefronts contained within system waveguides. Control of the degree of curvature of the wavefront enables the development of a wide variety of multi-waveguide arrays. The sound chambers are placed between a waveguides and flattened conical horns of secondary waveguides. The sound chambers transform the curvature of the typical fan shaped wavefront that results from a conical horn throat into a wavefront that approximates a planer or curved rectangular ribbon of sound.

Heinz, U.S. Pat. No. 5,526,456, describes a multiple-driver, singe horn loudspeaker is disclosed. The loudspeaker comprises an enclosure having a centerline and a single horn mounted therein. The horn has a throat located in the enclosure, and a mouth which is located at an open end of the enclosure. At least one high frequency driver is used to produce high frequency sound which is directed through a passage located along the centerline and are coupled to the throat of the horn. Low frequency drivers for producing low frequency sound are either located on either side of the centerline and are also coupled to the throat of the horn, or a single low frequency diver is located along the centerline and connected to the throat of the horn. The single horn acts as a waveguide for the sound produced by both the low and high frequency drivers.

Danley, U.S. Pat. No. 6,411,718, describes an invention relates to systems and methods for sound reproduction employing a unity summation aperture loudspeaker horn taking advantage of the frequency response of horn flare characteristics for positioning of audio drivers along the outer wall of the loudspeaker horn. The loudspeaker horn may be embodied as any of a variety of pyramid shapes, which allows for sections for driver positioning in correlation with the frequency response of the horn. Positioning the driver sources along the sides of the horn and out of the way of the audio field facilitates at least two modes of operation including a transformation operation for directing the reproduced audio signals. The single horn, multi-driver approach provides highly coupled audio drivers to generate sound reproduction employing unity summation aperture loudspeaker.

Engebretson U.S. Pat. No. 7,134,523, describes this invention provides a radiation boundary integrator ("RBI") for integrating sound radiation from mid-range and high frequency sources in multi-way loudspeakers. The RBI is a substantially solid boundary that is placed over the mid-range speakers to provide smooth, wave-guiding sidewalls to control the angular radiation of the high-frequency sound waves emanating from the high-frequency sound sources. To allow the mid-range frequency sound waves generated from mid-range sound sources t pass through the RBI, the RBI is designed with openings. To further prevent the possibility of having high-frequency sound radiate through the openings in the RBI, the RBI may be designed with porous material in the opening of the RBI. The porous material would be transparent to the mid-range sound radiation, but would prevent the high-frequency sound radiation, from being disturbed by the opening in the RBI. As such, the RBI provides an outer or front surface area that forms an acoustical barrier to high frequencies radiating across the front surface, yet is acoustically transparent to mid-range frequencies radiating through opening in the RBI. The RBI may also serve as a volume displacement device to compression-load the mid-range sound sources by contouring the back side of the to the shape of the mid-range sound sources thus reducing the space between the RBI and the mid-range sound sources and loading the mid-range sound to generate greater mid-range sound energy.

Webb, U.S. Pat. No. 6,621,909, describes a horn speaker comprises: a horn (22) having a throat (26) and a mouth (30); a primary electro-acoustic driver (24) mounted at or adjacent the throat of the horn and directed generally along the horn; and at least one secondary electro-acoustic driver (32T, 32B, 32 L, 32R) mounted part-way along the horn and directed generally across the horn. The secondary driver(s) can be used to change the local impedance conditions in the horn loudspeaker. At least one filter (12A, 12E) is provided for filtering an input signal (34) for the primary driver or each of the secondary drivers. Such a filter may be chosen or designed so as to optimize some aspect polar response of the horn loudspeaker, for example to increase directivity, or flatten the polar response within a specified included radiation angle, or to increase omnidirectionality.

The aforementioned prior art search with abstracts and detailed description described above teach certain benefits in sound reproduction. However, all of the prior arts described fail to teach a horn speaker system with sound radiators mounted symmetrically on the sides of a horn speaker with an additional device, a "Hyperbolic Paraboloid Lens", with a hyperbolic paraboloid shaped acoustic lens placed medially between multiple sound radiators to improve directivity characteristics by the coupling to the horn, hence improving horn directivity characteristics and beaming as a function of frequency. The present invention teaches advantageous features described in the following summary.

SUMMARY OF THE INVENTION

The new invention in on embodiment, FIG. 1 is a horn speaker includes a first and second sound radiator with a Hyperbolic Paraboloid (saddle point) shaped acoustic lens positioned medially between the first and the second sound radiators. The two sound radiators are mounted symmetrically on opposite sides of the horn, facing one another in such a manner that they are osculated (or in proximity) by the curvature of the aforementioned lens to uniformly compel the radiated sound forward. The horn/lens combination improves the directivity uniformity over its intended coverage angle by the sound radiators coupled to the horn with the Hyperbolic Paraboloid lens as a function of frequency.

Constant Directivity Horns have been desirable in sound reproduction for decades. In sound reproduction it is desirable to propagate sound equally and uniformly to the listeners at different parts at different sitting locations.

BRIEF DESCRIPTION OF THE DRAWINGS

The noted drawings show the best or preferred embodiment of the present invention.

DETAILED DESCRIPTION OF THE INVENTION

It must be understood that the illustrated embodiment have been set forth as an example and those having ordinary skills in the art may be able to make modifications without departing from its scope.

Figure 1:
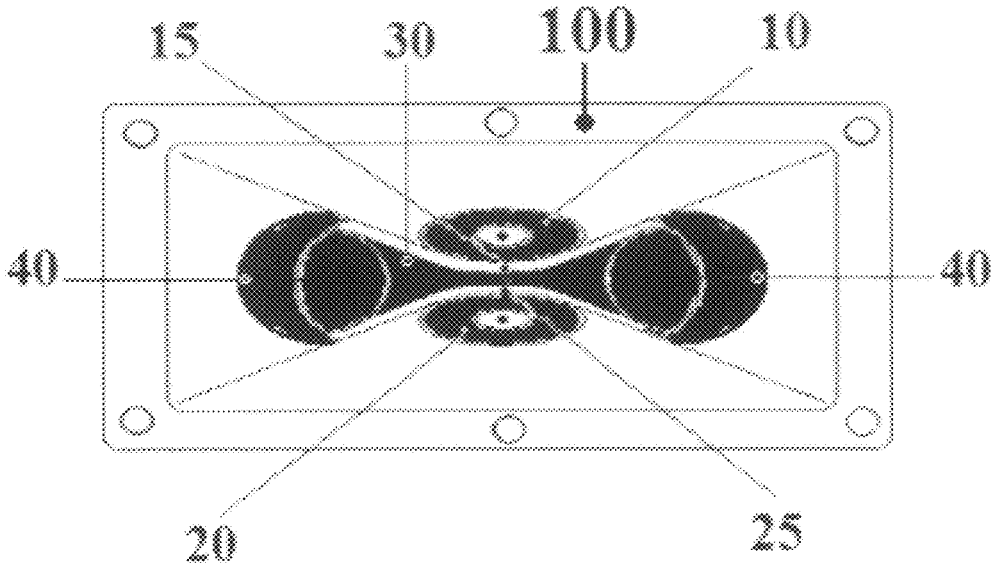
FIG. 1 shows a prospective view of the best embodiment.

FIG. 1 in one embodiment shows a horn speaker system 100 with a first 10, and second 20 sound radiators, in this specification, preferably two high or high/mid or mid frequency speakers or a combination, with a hyperbolic paraboloid acoustic lens 30 positioned medially between the first sound radiator 10 and the second sound radiator 20. A horn speaker in FIG. 1 may be comprised of more than one or equivalent sound radiators. The first 10 and second 20 sound radiators radiate in phase with each other to project the radiated sound waves toward the lens, thereby causing the projected sound wave to be coupled to the horn with radiating sound reflected from the lens 30 to project the sound waves forward away from the horn 100. FIG. 1 further illustrates the strategically placing the hyperbolic lens 30 in relation to the two sound radiators 10 and 20 to form a single beam of sound to radiate forward. The hyperbolic lens 30 is placed medially as to at least osculate (proximates) the sound radiators 10 and 20 at 15 and 25. The outer part 40 of the hyperbolic lens 30 are extended away from the sound radiators 10 and 20 due to the sound radiators 10 and 20 changes in there respective wavelength as a function of frequency.

Figure 2:
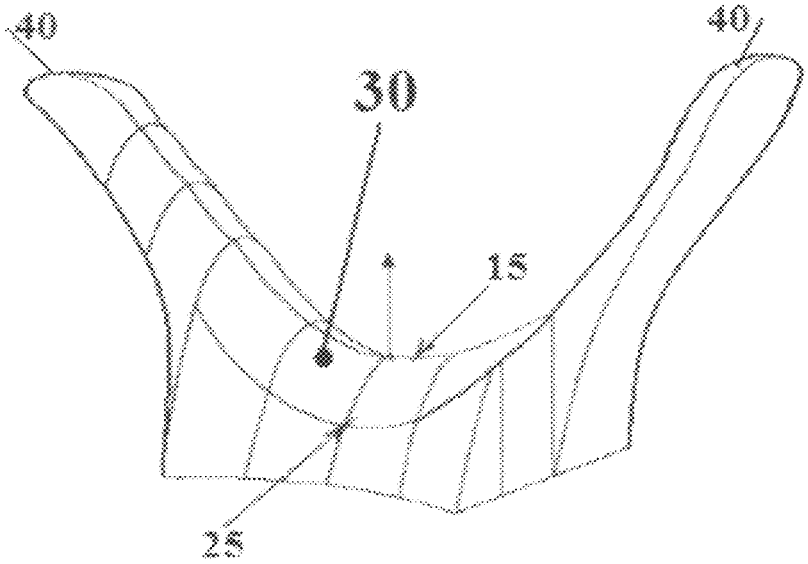
FIG. 2 shows a prospective view of the preferred hyperbolic parabloid lens embodiment with its associated points.

FIG. 2 shows the actual geometry of a hyperbolic paraboloid lens 30.

Figure 3:
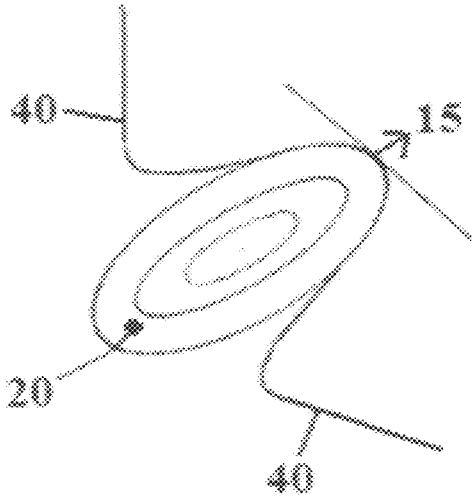
FIG. 3 shows a mechanism. It illustrated a radiator/horn that is coupled with the lens to achieve the objective of the invention.

FIG. 3 illustrates the mechanical relationship between the sound radiators 10 and 20 osculated by hyperbolic paraboloid lens 30 at 15 and 20 with associated part 40.

Figure 4:
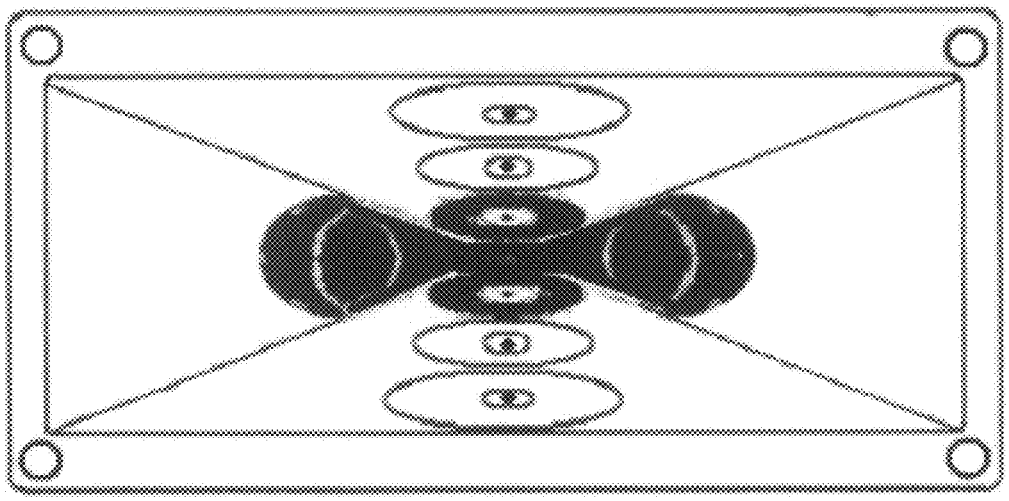
FIG. 4 shows a perspective view of the horn system with multiple sound radiators.
Figure 5:
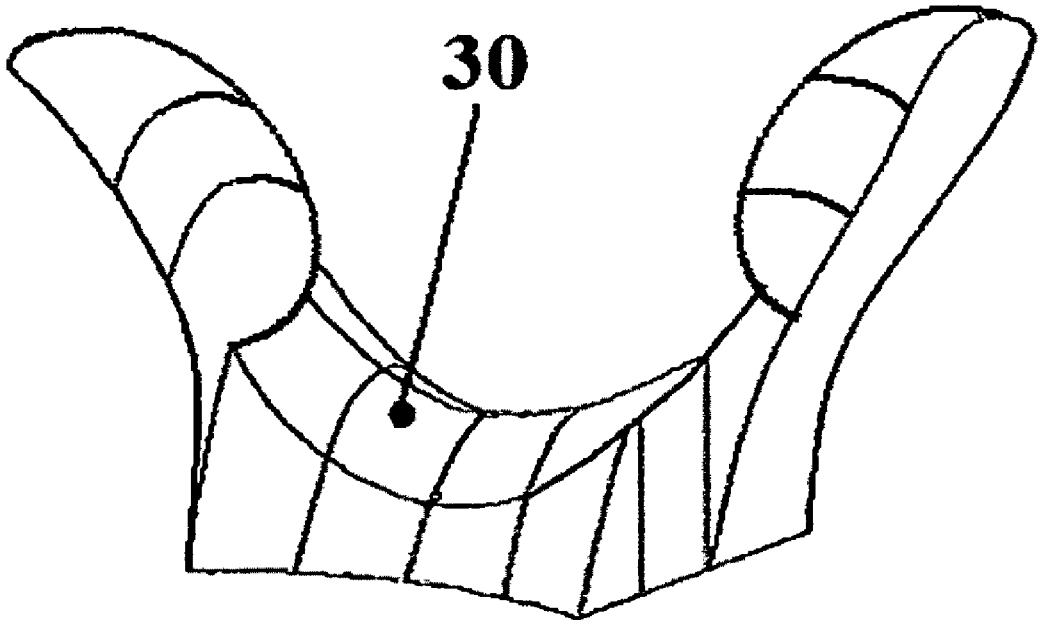
FIG. 5 shows a perspective of a still further variation of the "Hyperbolic Paraboloid Lens" shown in FIG. 2

FIG. 4 illustrates a horn speaker with the hyperbolic lens with multiple sound radiators.

While the invention has been described with reference to at least one preferred embodiment, it is to be understood by those skilled in the art that the invention is not limited thereto. Rather, the scope of the invention is to be interpreted only in conjunction with the appended claims and it is made clear, here, that the inventor believes that the claimed subject matter is the invention.

The invention claimed is:

1. A horn speaker system comprising: at least two sound radiators, a first and a second sound radiator; a lens wherein the lens has an acoustic "Hyperbolic Paraboloid" (saddle point) shape; a horn wherein each of the first and second sound radiators mounted on the side wall of the horn speaker facing one another and wherein the lens is placed within the horn medially between the two sound radiators to project sound forward.

2. A horn speaker system, the speaker in claim 1 wherein the sound radiators are osculated by the hyperbolic paraboloid (saddle point) shaped lens curvature; wherein there is a common tangent at the point of contact between the radiator and the lens.

3. A horn speaker system, the speaker in claim 1 wherein the lens in claim 1 improves the directivity of the horn speaker as a function of frequency by the lens curvature diffraction.

4. A horn speaker system, the speaker in claim 1 wherein the lens in claim 1 reduces horn beaming as a function of frequency; wherein the sound waves are smaller in wavelength than the physical dimensions of the lens, diffracted by the lens, rearranged and redirected to impede the forward radiation of the sound, hence reducing the output level in the forward direction and to assist the output level in all other directions other than forward direction.

5. A horn speaker system, a speaker system in claim 1 wherein uniform power response is achieved by the horn and lens combination.

6. A horn speaker system in claim 1 wherein the on-axis output of the horn is controlled by varying the lens parameters.

7. A horn speaker system in claim 1 wherein the off-axis output level of the horn controlled by varying the lens parameters and horn curvature.

8. A horn speaker system, the speaker in claim 1 wherein the lens in claim 1 the lens may be integrated together with the horn body to form a single part to substantially achieve similar results and not to change the function of the horn and lens speaker system.

9. A horn speaker system in claim 1 wherein the horn itself is an enclosure with parallel walls or similar configuration to achieve substantially the similar results.

10. A horn speaker system, the speaker in claim 1 wherein a horn speaker system further comprises at least one additional sound radiator.

11. A horn speaker system, the speaker system in claim 10 wherein a hyperbolic paraboloid shaped lens is medially placed between the sound radiators, such as sound radiators for high, mid or low frequencies in claim 1.

* * * * *